US008025250B2

(12) United States Patent
Spruell et al.

(10) Patent No.: US 8,025,250 B2
(45) Date of Patent: Sep. 27, 2011

(54) PROVIDING LENGTH EQUALIZATION

(75) Inventors: Stephen L. Spruell, Carrollton, GA (US); Carol J. Godfrey, Roswell, GA (US); Jeff Herrin, Carrollton, GA (US); Emory Barber, Bremen, GA (US); Dewey L. Smith, Carrollton, GA (US); Charlie W. Reese, Carrollton, GA (US)

(73) Assignee: Southwire Company, Carrollton, GA (US)

( * ) Notice: Subject to any disclaimer, the term of this patent is extended or adjusted under 35 U.S.C. 154(b) by 295 days.

(21) Appl. No.: 12/348,109

(22) Filed: Jan. 2, 2009

(65) Prior Publication Data

US 2009/0173818 A1 Jul. 9, 2009

Related U.S. Application Data

(60) Provisional application No. 61/018,950, filed on Jan. 4, 2008.

(51) Int. Cl.
*B65H 54/02* (2006.01)

(52) U.S. Cl. ..... 242/472.8; 242/615.2; 242/157.1

(58) Field of Classification Search ..... 242/472.8, 242/174, 178, 470, 615.2, 157.1, FOR. 110; 57/345, 344, 346, 347, 348, 349, 293, 58.59; 140/139, 147, 92.1
See application file for complete search history.

(56) References Cited

U.S. PATENT DOCUMENTS 2,882,674 A * 4/1959 Lenk ..... 57/66
3,847,190 A * 11/1974 Forester ..... 140/149
* cited by examiner

*Primary Examiner* — William E Dondero
(74) *Attorney, Agent, or Firm* — Merchant & Gould

(57) ABSTRACT

Length equalization may be provided. First, a plurality of conductors may be paid off from a plurality of pay-off devices respectively corresponding to the plurality of conductors to form a cable. The plurality of conductors comprising the cable may then be wound onto a take-up device. During the winding process, a guide device may be rotated to cause the plurality of conductors to have substantially a same length after the cable has been wound onto the take-up device. The guide device may be disposed between the take-up device and the plurality of pay-off devices. The guide device may have holes respectively corresponding to each of the plurality of conductors. Each of the plurality of conductors may pass through a respective hole in the guide device.

13 Claims, 8 Drawing Sheets

PARALLELED CONDUCTORS 115, 120 AND 125 ARE PLACED ONTO A TAKEUP PACKAGE

FOR 1 REVOLUTION OF TAKEUP PACKAGE:

LENGTH OF CONDUCTOR 115 = $2\pi R_1$

LENGTH OF CONDUCTOR 125 = $2\pi R_2$

LENGTH OF 125 > LENGTH OF 115

PROVIDING LENGTH EQUALIZATION

RELATED APPLICATION

Under provisions of 35 U.S.C. §119(e), the Applicants claim the benefit of U.S. provisional application No. 61/018,950, filed Jan. 4, 2008, which is incorporated herein by reference.

COPYRIGHTS

All rights, including copyrights, in the material included herein are vested in and the property of the Applicants. The Applicants retain and reserve all rights in the material included herein, and grant permission to reproduce the material only in connection with reproduction of the granted patent and for no other purpose.

BACKGROUND

When conductors are manufactured, they may be cut to length. A number of the conductor lengths may be placed together on a same wound package (e.g. a take-up reel) as one cable. This may be referred to as "paralleling" conductors into a cable assembly. For example, three conductors may be placed together, wound on a reel, and considered one cable on the reel.

SUMMARY

This Summary is provided to introduce a selection of concepts in a simplified form that are further described below in the Detailed Description. This Summary is not intended to identify key features or essential features of the claimed subject matter. Nor is this Summary intended to be used to limit the claimed subject matter's scope.

Length equalization may be provided. First, a plurality of conductors may be paid off from a plurality of pay-off devices respectively corresponding to the plurality of conductors to form a cable. The plurality of conductors comprising the cable may then be wound onto a take-up device. During the winding process, a guide device may be rotated to cause the plurality of conductors to have substantially a same length after the cable has been wound onto the take-up device. The guide device may be disposed between the take-up device and the plurality of pay-off devices.

Both the foregoing general description and the following detailed description provide examples and are explanatory only. Accordingly, the foregoing general description and the following detailed description should not be considered to be restrictive. Further, features or variations may be provided in addition to those set forth herein. For example, embodiments may be directed to various feature combinations and subcombinations described in the detailed description.

BRIEF DESCRIPTION OF THE DRAWINGS

The accompanying drawings, which are incorporated in and constitute a part of this disclosure, illustrate various embodiments of the present invention. In the drawings.

DETAILED DESCRIPTION

Figure 1:
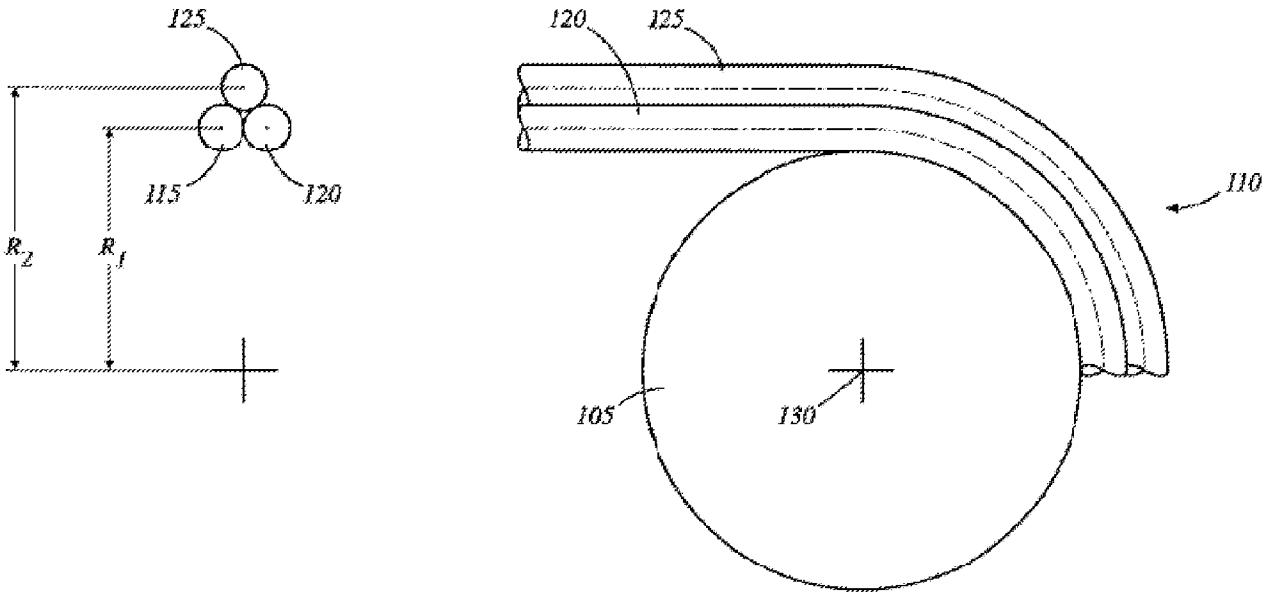
FIG. 1 Prior Art
FIG. 1 shows a conventional conductor take-up process.

The following detailed description refers to the accompanying drawings. Wherever possible, the same reference numbers are used in the drawings and the following description to refer to the same or similar elements. While embodiments of the invention may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the invention.

FIG. 1 shows a conventional conductor take-up process. As shown in FIG. 1, a take-up reel 105 is used to wind a cable 110. Cable 110 comprises a first conductor 115, a second conductor 120, and a third conductor 125. First conductor 115, second conductor 120, and third conductor 125 are placed together and wound around take-up reel 105 as cable 110. During this conventional process, one of the three conductors (i.e. third conductor 125) will be positioned on top of the other conductors (i.e. first conductor 115 and second conductor 120). Furthermore, FIG. 1 shows a radius (i.e. R1) between a center of rotation 130 on take-up reel 105 and a point at a center of first conductor 115 and second conductor 120. Also shown in FIG. 1 is a radius (i.e. R2) between center of rotation 130 on take-up reel 105 and a point at the center of third conductor 125.

As shown in FIG. 1, in this conventional process, radius R2 is larger than radius R1. This larger radius R2 will result in a longer length of third conductor 125 being wound onto take-up reel 105 during this process for each revolution when winding cable 110 on take-up reel 105. For each revolution of take-up reel 105, the length of first conductor 115 and second conductor 120 is $2\pi R1$. Similarly, for each revolution of take-up reel 105, the length of third conductor 125 is $2\pi R2$. As a result, when cable 110 is taken off take-up reel 105 for installation, third conductor 125 at the top of cable 110 will have a longer length. This longer length is problematic because it can create a loop in cable 110 that can hang up or become damaged as take-up reel 105 empties when cable 110 is installed. This longer length of third conductor 125 is also wasteful because it may be cut out as take-up reel is emptied resulting in scrap. Consequently, the conventional system has an undesirable unequal length problem.

Figure 2:
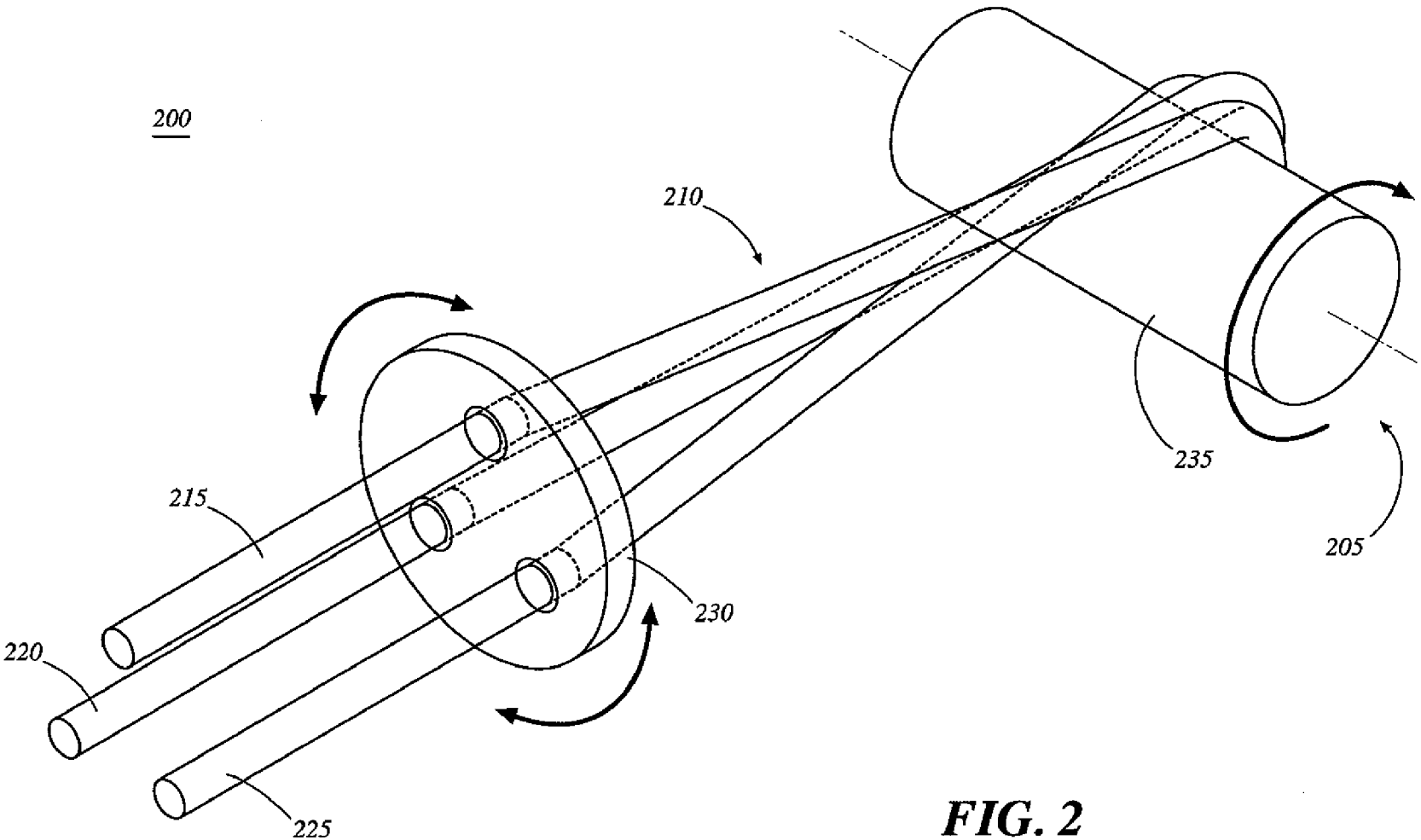
FIG. 2 shows a system for providing length equalization.

FIG. 2 shows a system 200 consistent with embodiments of the invention for providing length equalization. System 200 may solve the undesirable unequal length problem as described above. As shown in FIG. 2, system 200 may include a take-up device 205 for taking up a cable 210. Cable 210 may comprise, for example, a first conductor 215, a second conductor 220, and a third conductor 225 (e.g. "the conductors"). Notwithstanding, cable 210 may comprise any number of conductors and is not limited to three conductors. First conductor 215, second conductor 220, and third conductor 225 may be paid off of respective pay-off devices as they are being fed onto take-up device 205.

System 200 may also include a guide device 230. Consistent with embodiments on the invention, guide device 230 may be placed between the aforementioned pay-off devices and take-up device 205 that packages the conductors into cable 210 on take-up device 205. For example, cable 210 may be wound onto a substantially cylindrical surface 235 of take-up device 205. While system 200 shows three conductors, embodiments of the invention may work for any number of conductors.

Guide device 230 may comprise a lay plate or guide plate that may continuously rotate as the conductors pass through it. For example, if 1,000 ft. of cable 210 is to be placed on take-up device 205, guide device 230 may make one complete rotation (i.e. 360 degrees) for every 250 ft. of cable 210. The rotation may constantly alternate from clockwise to counterclockwise. The rotation degree may be the same in each direction (i.e. clockwise and counterclockwise) before reversal or may be different. By rotating the conductors using guide device 230 (or using any other process or device), embodiments of the invention may cause the conductors in cable 210 to spend substantially the same amount of time in the "top" position in cable 210 relative to surface 235 of take-up device 205. This may result in a more equal length of all the conductors in cable 210 at the finish of the winding process of cable 210 onto take-up device 205.

When it is time to use cable 210 and it is unwound from take-up device 205, cable 210 under tension may return to an original state (e.g. each of the conductors can be separated easily) and the conductors may be more nearly the same length when cable 210 is unwound. Consequently, it may be easier to pay out cable 210 when it is ready to be used. Less scrap may result because the conductors may be substantially the same length, thus none may need to be trimmed or very little trimming may be needed. Moreover, because the conductors may be substantially the same length, no loops may be created in cable 210 that may hang up or become damaged as take-up device 205 empties when cable 210 is installed.

Figure 3:
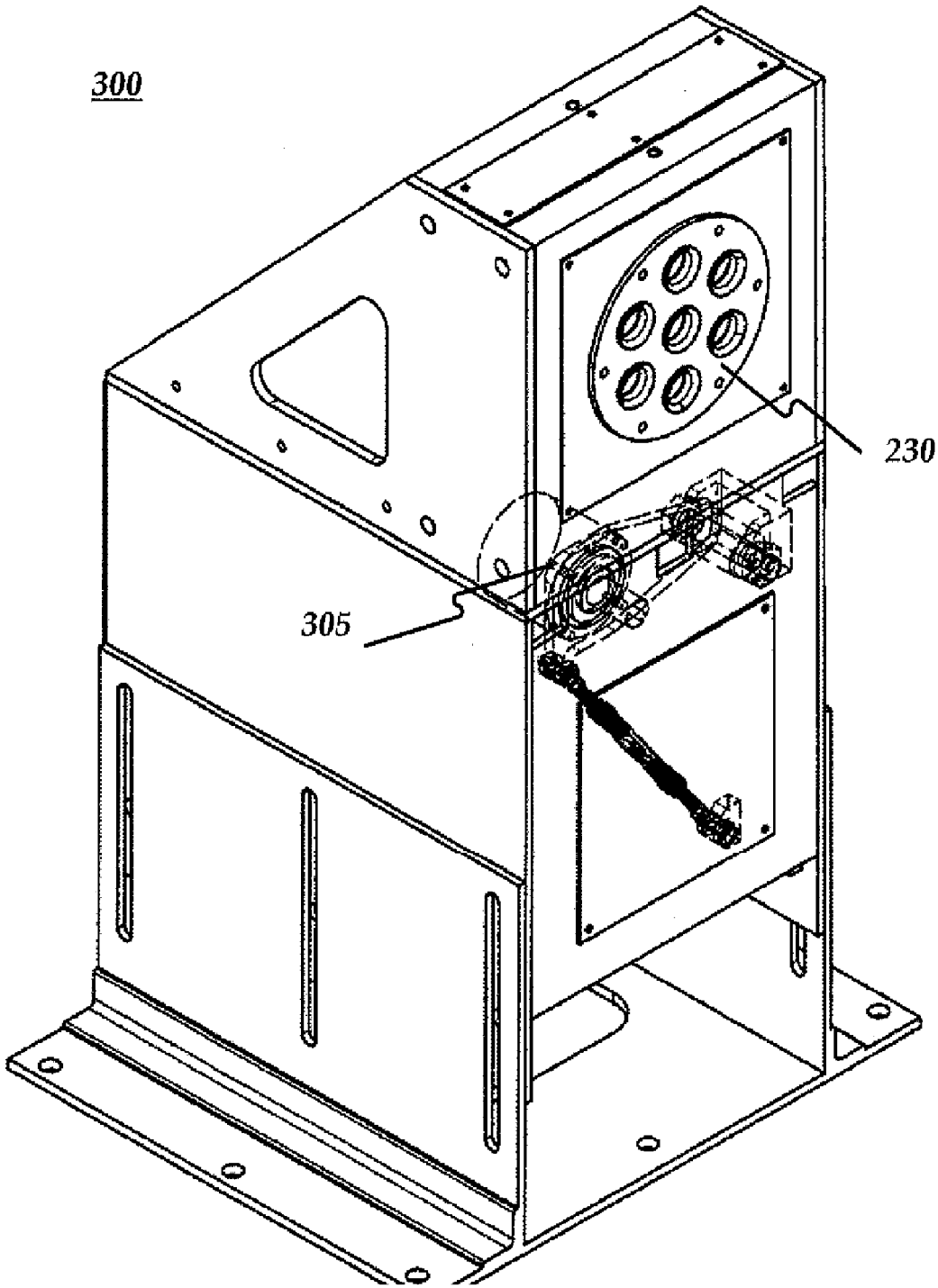
FIG. 3 shows an oscillator assembly.
Figure 4:
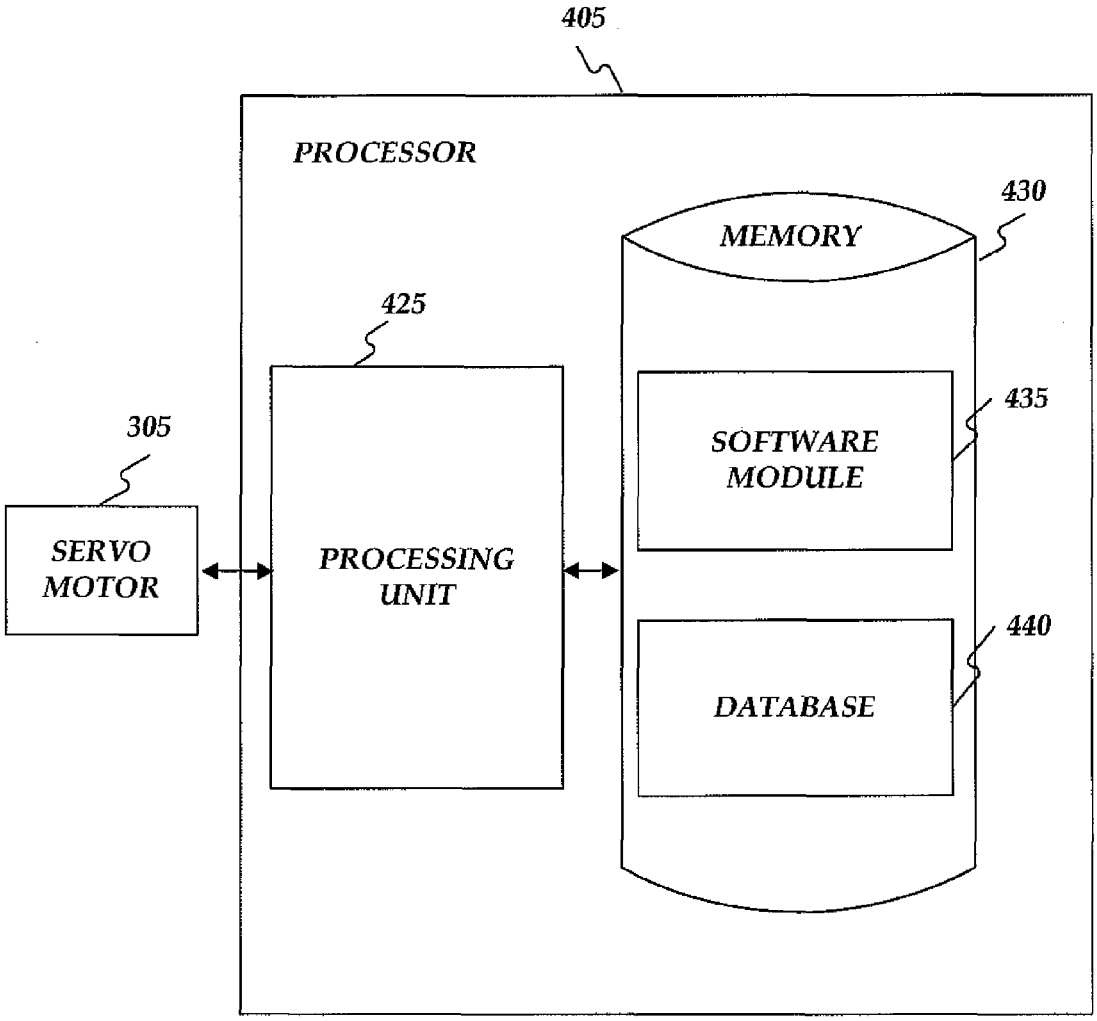
FIG. 4 shows a processor.

FIG. 3 shows an oscillator assembly 300. Oscillator assembly 300 may include guide device 230. A servo motor 305 may be connected to guide device 230. Servo motor 305 may be driven to rotate guide device 230. For example, servo motor 305 may be driven to rotate guide device 230 a predetermined distance and may alternate this rotation from clockwise to counterclockwise. Any suitable combination of hardware, software, or firmware may be used to drive servo motor 305. For example, servo motor 305 may be driven by a processor 405 shown in FIG. 4. As shown in FIG. 4, processor 405 may include a processing unit 425 and a memory 430. Memory 430 may include a software module 435 (e.g. a computer program product) and a database 440. While executing on processing unit 425, software module 435 may perform processes for driving servo motor 305.

Processor 405 may be implemented using a personal computer, network computer, a programmable logic controller (PLC), portable computer, a hand held computer, mainframe, or other similar microcomputer-based workstation. Processor 405 may though comprise any type of computer operating environment, such as hand-held devices, multiprocessor systems, microprocessor-based or programmable sender electronic devices, minicomputers, mainframe computers, and the like. Processor 405 may also be practiced in distributed computing environments where tasks are performed by remote processing devices. The aforementioned systems and devices are examples and processor 405 may comprise other systems or devices.

Figure 5A:
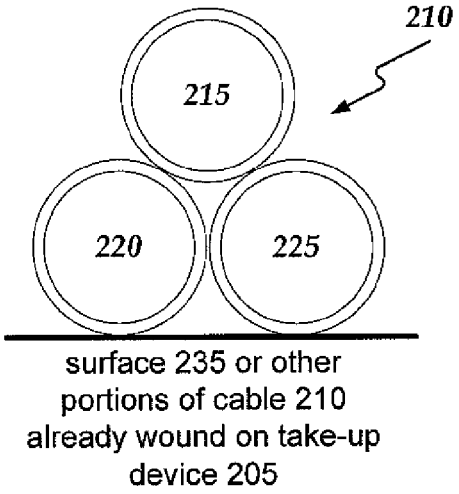
FIG. 5A, FIG. 5B, and FIG. 5C illustrate how a cable may be rotated.
Figure 5B:
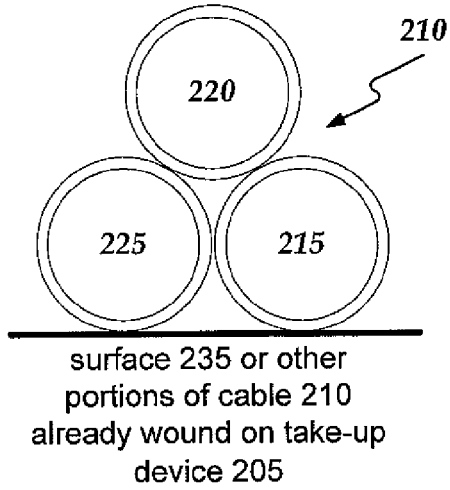
Figure 5C:
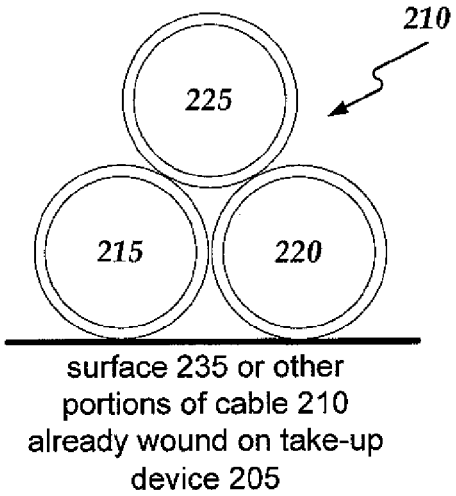

Consistent with embodiments of the invention, servo motor 305 may be driven in any manner to rotate guide device 230 that causes the conductors comprising cable 210 to each have substantially the same "dwell time" against surface 235 or other portions of cable 210 already wound on take-up device 205. In other words, cable 210 may be rotated during the winding process so that each of the conductors in cable 210 may be substantially the same length after all of cable 210 is wound on take-up device 205. FIG. 5A, FIG. 5B, and FIG. 5C illustrate how cable 210 may be rotated. As shown in FIG. 5A, FIG. 5B, and FIG. 5C, the conductors of cable 210 may be wound onto take-up device 205. During the winding process, cable 210 may initially be wound onto surface 235 and then, once surface 235 is covered by cable 210, cable 210 may begin to be wound onto itself on take-up device 205.

FIG. 5A shows first conductor 215 on top with second conductor 220 at the bottom left and third conductor 225 at the bottom right as cable 210 is wound onto take-up device 205. Next during the winding process, guide device 230 may be rotated clockwise to cause the conductor configuration shown in FIG. 5B. As shown in FIG. 5B, second conductor 220 may be on top with third conductor 225 at the bottom left and first conductor 215 at the bottom right as cable 210 is wound onto take-up device 205. Then during the winding process, guide device 230 may be rotated counterclockwise, back through the positions shown in FIG. 5A and then to the configuration shown in FIG. 5C. As shown in FIG. 5C, third conductor 225 may be on top with first conductor 215 at the bottom left and second conductor 220 at the bottom right as cable 210 is wound onto take-up device 205. Consequently, guide device 230 may rotate cable 210 during the winding process so that each of the conductors in cable 210 may be substantially the same length after all of cable 210 is wound on take-up device 205. In other words, if cable 210 is wound onto take-up device 205 where respective substantially equal lengths of cable 210 have the respective configurations of FIG. 5A, FIG. 5B, and FIG. 5C, the conductors comprising cable 210 may each have substantially the same "dwell time" against surface 235 or other portions of cable 210 already wound on take-up device 205. Having substantially the same "dwell time" may mean that each of the conductors in cable 210 may be substantially the same length after all of cable 210 is wound on take-up device 205. While FIG. 5A, FIG. 5B, and FIG. 5C illustrate cable 210 having three conductors, cable 210 is not so limited and may comprise any number of conductors in any geometric configuration.

Consistent with embodiments of the invention, servo motor 305 may be driven in any manner to rotate guide device 230 that causes cable 210 to be rotated during the winding process so that each of the conductors in cable 210 may be substantially the same length after all of cable 210 is wound on take-up device 205. Embodiments of the invention may be configured to rotate guide device in a first direction from an initial position a first distance, then rotate in a second direction that is opposite to the first direction back to through the initial position a second distance from the initial position. The first direction may be clockwise or counterclockwise. The first distance may be less than 360 degrees. Similarly, the second distance may be less than 360 degrees. The first distance and the second distance may be substantially equal. Consequently, guide device 230 may be caused to oscillate.

The following equation illustrates an angular velocity function by which guide device 230 may be rotated to cause each of the conductors in cable 210 to be substantially the same length after all of cable 210 is wound on take-up device 205.

$$V(t)=Z\,\mathrm{Cos}(S\pi t/60d);\ \text{where}$$

S=line speed at which cable 210 is moving (fpm);
d=distance on cable 210 between reversals (ft.);
N=# of twists of guide device 230;
t=time (s); and
Z=speed coefficient=$\pi$NS/d.

Figure 6:
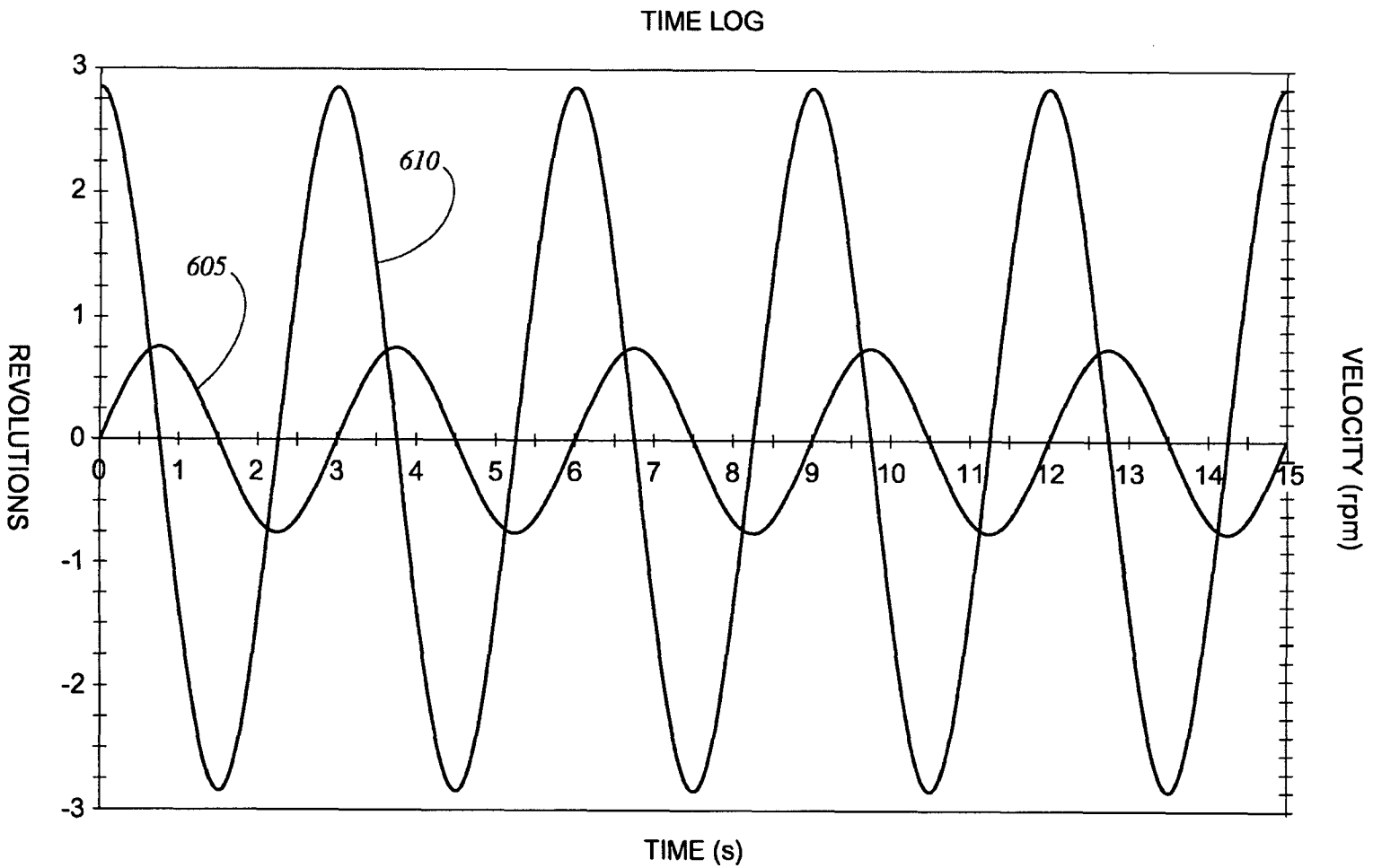
FIG. 6 shows a time log of a function.
Figure 7:
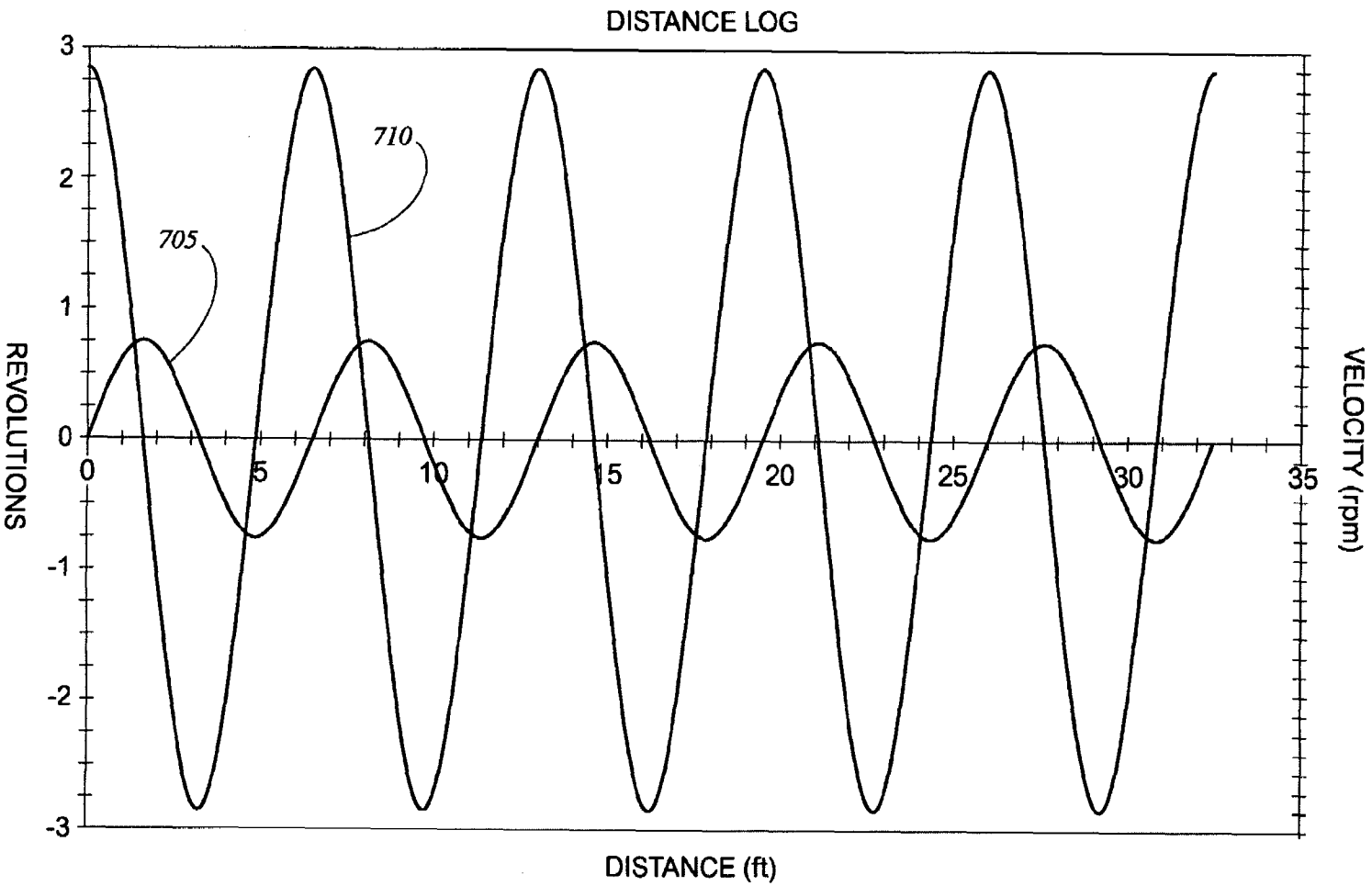
FIG. 7 shows a distance log of a function.

Software module 435 of processor 405 may be programmed to drive servo motor 305 to cause guide device 230 to be rotated according to the above equation. Furthermore, any suitable combination of hardware, software, or firmware may be used to drive servo motor 305 to cause guide device 230 to be rotated according to the above equation. Embodiments of the invention are not limited to the above equation and any equation may be used to cause cable 210 to be rotated during the winding process so that each of the conductors in cable 210 may be substantially the same length after all of cable 210 is wound on take-up device 205. FIG. 6 shows a time log of the above function where d=39 in., N=¾, and S=130 fpm. Curve 605 represents revolutions of guide device 230 and curve 610 represents the angular velocity of guide device 230. FIG. 7 shows a distance log of the above function where d=39 in., N=¾, and S=130 fpm. Curve 705 represents revolutions of guide device 230 and curve 710 represents the angular velocity of guide device 230.

Figure 8A:
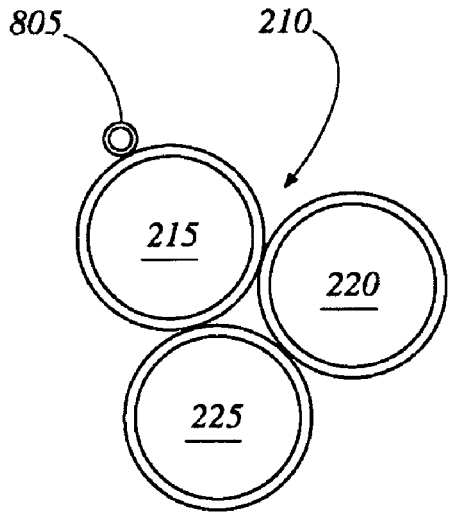
FIGS. 8A and 8B show a cable with a binding element.
Figure 8B:
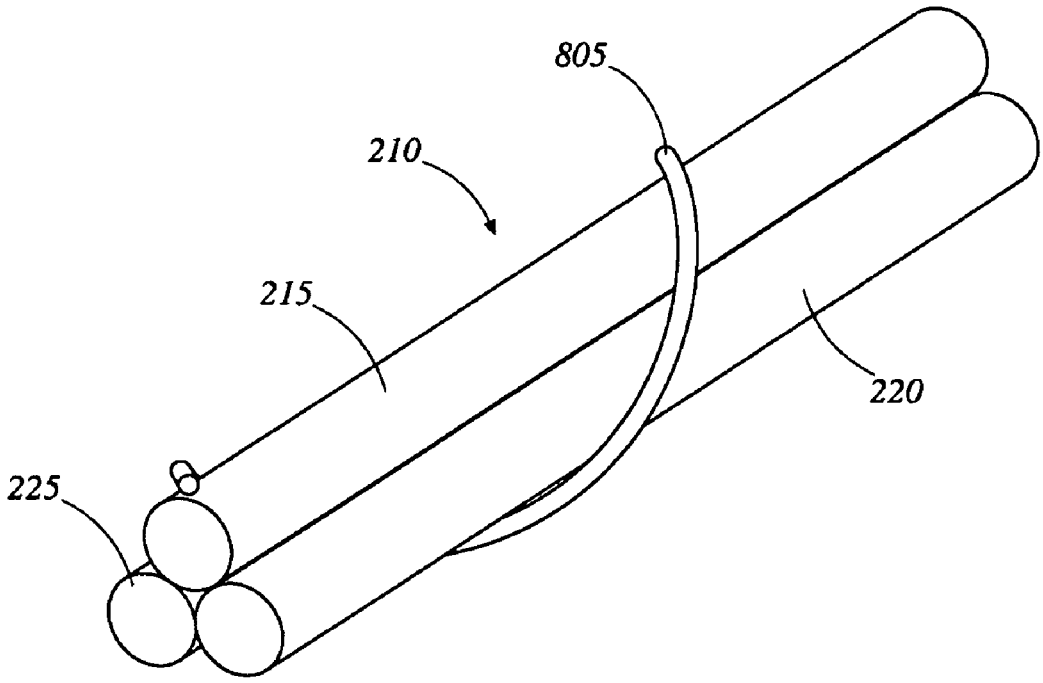

Consistent with embodiments of the invention, the conductors may be held together by a contact force as they are placed on take-up device 205 and come into contact with other portions of cable 210 or surface 235 of take-up device 205. Furthermore, as shown in FIGS. 8A and 8B, a binding element 805 may be used to help keep cable 210 in a desired orientation as cable 210 is wound onto take-up device 205. Binding element 805 may be applied helixically to the exterior of cable 210. Binding element 805 may comprise, but is not limited to, a metallic wire that may be coated with a coating material. The coating material may comprise, but is not limited to, polyethylene, polyvinyl chloride (PVC), or nylon. Notwithstanding, binding element 805 may comprise or otherwise include any material that may be configured to cause a low or lessened coefficient of friction between cable 210 and a conduit or duct. For example, the coating material may excrete or leach a lubricant. Moreover, binding element 805 may also be optimized to be of adequate hardness so that it minimizes deformation to binding element 805 and therefore minimizes surface contact between binding element 805 and a surface that binding element 805 slides across.

Cable 210 may include any number of conductors (e.g. insulated or otherwise) and may include any number of ground wires or may not include a ground wire. Any one or more of the conductors in cable 210 may be configured to be a neutral wire, or none of the conductors in cable 210 may be configured to be a neutral wire. Any one or more of the conductors in cable 210 may have an insulation color indicating that any one or more of the conductors in cable 210 as a neutral(s). Furthermore, the conductors in cable 210 may all be the same size or they may vary individually or in any sub-combination by size. In addition, the conductors in cable 210 may all be made of the same material (e.g. copper, aluminum, etc.) or they may vary individually or in any sub-combination by material. Also, the conductors in cable 210 may all be stranded or solid or they may vary individually or in any sub-combination by being stranded or solid.

Generally, consistent with embodiments of the invention, program modules may include routines, programs, components, data structures, and other types of structures that may perform particular tasks or that may implement particular abstract data types. Moreover, embodiments of the invention may be practiced with other computer system configurations, including hand-held devices, multiprocessor systems, microprocessor-based or programmable consumer electronics, minicomputers, mainframe computers, and the like. Embodiments of the invention may also be practiced in distributed computing environments where tasks are performed by remote processing devices that are linked through a communications network. In a distributed computing environment, program modules may be located in both local and remote memory storage devices.

As stated above, any suitable combination of hardware, software, or firmware may be used to drive servo motor 305 as described above. For example, embodiments of the invention may be implemented in an electrical circuit comprising discrete electronic elements, packaged or integrated electronic chips containing logic gates, a circuit utilizing a microprocessor, or on a single chip containing electronic elements or microprocessors. Embodiments of the invention may also be practiced using other technologies capable of performing logical operations such as, for example, AND, OR, and NOT, including but not limited to mechanical, optical, fluidic, and quantum technologies. In addition, embodiments of the invention may be practiced within a general purpose computer or in any other circuits or systems.

Embodiments of the invention, for example, may be implemented as a computer process (method), a computing system, or as an article of manufacture, such as a computer program product or computer readable media. The computer program product may be a computer storage media readable by a computer system and encoding a computer program of instructions for executing a computer process. The computer program product may also be a propagated signal on a carrier readable by a computing system and encoding a computer program of instructions for executing a computer process. Accordingly, the present invention may be embodied in hardware and/or in software (including firmware, resident software, micro-code, etc.). In other words, embodiments of the present invention may take the form of a computer program product on a computer-usable or computer-readable storage medium having computer-usable or computer-readable program code embodied in the medium for use by or in connection with an instruction execution system. A computer-usable or computer-readable medium may be any medium that can contain, store, communicate, propagate, or transport the program for use by or in connection with the instruction execution system, apparatus, or device.

The computer-usable or computer-readable medium may be, for example but not limited to, an electronic, magnetic, optical, electromagnetic, infrared, or semiconductor system, apparatus, device, or propagation medium. More specific computer-readable medium examples (a non-exhaustive list), the computer-readable medium may include the following: an electrical connection having one or more wires, a portable computer diskette, a random access memory (RAM), a read-only memory (ROM), an erasable programmable read-only memory (EPROM or Flash memory), an optical fiber, and a portable compact disc read-only memory (CD-ROM). Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory.

Embodiments of the present invention, for example, are described above with reference to block diagrams and/or operational illustrations of methods, systems, and computer program products according to embodiments of the invention. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

While certain embodiments of the invention have been described, other embodiments may exist. Furthermore, although embodiments of the present invention have been described as being associated with data stored in memory and other storage mediums, data can also be stored on or read from other types of computer-readable media, such as secondary storage devices, like hard disks, floppy disks, or a CD-ROM, a carrier wave from the Internet, or other forms of RAM or ROM. Further, the disclosed methods' stages may be modified in any manner, including by reordering stages and/or inserting or deleting stages, without departing from the invention.

While certain embodiments of the invention have been described, other embodiments may exist. Further, the disclosed methods' stages may be modified in any manner, including by reordering stages and/or inserting or deleting stages, without departing from the invention. While the specification includes examples, the invention's scope is indicated by the following claims. Furthermore, while the specification has been described in a language specific to structural features and/or methodological acts, the claims are not limited to the features or acts described above. Rather, the specific features and acts described above are disclosed as examples for embodiments of the invention.

What is claimed is:

1. A system for providing length equalization, the system comprising:

a plurality of pay-off devices respectively corresponding to a plurality of conductors, the plurality of pay-off devices configured to respectively pay off the plurality of conductors to form a cable;

a take-up device configured to take up the plurality of conductors comprising the cable; and a guide device disposed between the take-up device and the plurality of pay-off devices, the guide device configured to rotate to cause the plurality of conductors to have substantially a same length after the cable has been wound onto the take-up device, wherein the guide device being configured to rotate comprises the guide device being configured to rotate in a first direction from an initial position a first distance, then rotate in a second direction that is opposite to the first direction back to through the initial position a second distance from the initial position, wherein the first distance is less than 360 degrees and the second distance is less than 360 degrees.

2. The system of claim 1, wherein the plurality of conductors comprise at least three conductors.

3. The system of claim 1, wherein the take-up device being configured to take up the plurality of conductors comprises the take-up device being configured to take up the plurality of conductors comprising the cable onto a substantially cylindrical surface.

4. The system of claim 1, wherein the guide device has holes respectively corresponding to each of the plurality of conductors.

5. The system of claim 1, wherein the guide device has holes respectively corresponding to each of the plurality of conductors, each of the plurality of conductors passing through a respective hole in the guide device.

6. The system of claim 1, wherein the first distance and the second distance are substantially equal.

7. The system of claim 1, wherein the first direction is one of the following: clockwise and counterclockwise.

8. The system of claim 1, wherein the guide device being configured to rotate comprises the guide device being configured to oscillate with an angular velocity described by the following equation, $$V(t)=Z\,\mathrm{Cos}(S\pi t/60d);\ \text{where}$$

S=line speed at which the cable is moving;

d=distance on the cable between reversals;

N=# of twists of the guide device;

t=time (s); and

Z=speed coefficient=πNS/d.

9. A method for providing length equalization, the method comprising:

paying off a plurality of conductors from a plurality of pay-off devices respectively corresponding to the plurality of conductors to form a cable, the plurality of conductors comprising at least three conductors;

winding the plurality of conductors comprising the cable onto a take-up device; and rotating a guide device to cause the plurality of conductors to have substantially a same length after the cable has been wound onto the take-up device, the guide device being disposed between the take-up device and the plurality of pay-off devices, the guide device having holes respectively corresponding to each of the plurality of conductors, each of the plurality of conductors passing through a respective hole in the guide device wherein rotating the guide device comprises rotating the guide device in a first direction from an initial position a first distance, then rotating the guide device in a second direction that is opposite to the first direction back to through the initial position a second distance from the initial position, wherein rotating the guide device comprises rotating the guide device wherein the first distance is less than 360 degrees and the second distance is less than 360 degrees.

10. The method of claim 9, wherein rotating the guide device comprises rotating the guide device wherein the first distance and the second distance are substantially equal.

11. The method of claim 9, wherein rotating the guide device comprises rotating the guide device wherein the first direction is one of the following: clockwise and counterclockwise.

12. The method of claim 9, wherein rotating the guide device comprises oscillating the guide device with an angular velocity described by the following equation, $$V(t)=Z\,\mathrm{Cos}(S\pi t/60d);\ \text{where}$$

S=line speed at which the cable is moving;

d=distance on the cable between reversals;

N=# of twists of the guide device;

t=time (s); and

Z=speed coefficient=πNS/d.

13. A system for providing length equalization, the system comprising:

a guide device having holes respectively corresponding to each of a plurality of conductors;

a servo motor operatively connected to the guide device;

a memory having stored thereon a program; and a processor in electrical communication with the servo motor and the memory, the processor, upon execution of the program, being configured to:

rotate, a first angular distance from an initial position, the guide device to cause the plurality of conductors to have substantially a same length after a cable, formed by the plurality of conductors, has been wound onto a take-up device, rotate, a second angular distance, the guide device, the second angular distance being opposite the first angular distance, and rotate the guide device the first angular distance and the second angular distance with an angular velocity described by the following equation, V(t)=Z cos(Sπt/60d);

wherein, S=line speed at which the cable is moving, d=distance on the cable between reversals, N=# of twists of the guide device, t=time (s), and Z=speed coefficient=πNS/d, and wherein the first angular distance and the second angular distance are each less than 360 degrees from the initial position.

* * * * *